US009275573B2

(12) United States Patent
Lee et al.

(10) Patent No.: US 9,275,573 B2
(45) Date of Patent: Mar. 1, 2016

(54) DISPLAY APPARATUS

(71) Applicant: Samsung Display Co., Ltd., Yongin, Gyeonggi-do (KR)

(72) Inventors: Jae-Hoon Lee, Yongin (KR); Il-Hun Jeong, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 156 days.

(21) Appl. No.: 13/938,002

(22) Filed: Jul. 9, 2013

(65) Prior Publication Data

US 2014/0091992 A1 Apr. 3, 2014

(30) Foreign Application Priority Data

Sep. 28, 2012 (KR) ..... 10-2012-0108568

(51) Int. Cl.
*G09G 3/30* (2006.01)
*G09G 3/32* (2006.01)

(52) U.S. Cl.
CPC ..... *G09G 3/3208* (2013.01); *G09G 3/3233* (2013.01); *G09G 2300/0426* (2013.01); *G09G 2300/0809* (2013.01)

(58) Field of Classification Search
CPC ..... G09G 3/3208; G09G 3/3233; G09G 2300/0426; G09G 2300/0809
USPC ..... 345/1.3, 76–108, 211, 212, 690; 257/91, 40; 313/504, 505, 511; 315/169.3; 361/720
See application file for complete search history.

(56) References Cited

U.S. PATENT DOCUMENTS 6,252,643 B1 * 6/2001 Song ..... G02F 1/1362 349/139
8,188,942 B2 * 5/2012 Yoo et al. ..... 345/76
8,614,591 B2 * 12/2013 Kim et al. ..... 324/762.07
8,648,477 B2 * 2/2014 Kim ..... H01L 23/4985 257/773
8,665,191 B2 * 3/2014 Kwak ..... 345/82
2007/0013637 A1 * 1/2007 Moon ..... G09G 3/006 345/98
2007/0187677 A1 * 8/2007 Park et al. ..... 257/40
2007/0235791 A1 * 10/2007 Park ..... H01L 27/3276 257/312
2008/0218090 A1 * 9/2008 Yoo et al. ..... 315/169.3
2008/0303755 A1 * 12/2008 Oh ..... 345/76
2009/0108738 A1 * 4/2009 Kwak ..... 313/504
2009/0184899 A1 * 7/2009 Kim et al. ..... 345/76
2009/0310051 A1 * 12/2009 Kim ..... G02F 1/136204 349/40

(Continued)

FOREIGN PATENT DOCUMENTS

KR 10-2009-0079549 A 7/2009
KR 10-2010-0048412 A 5/2010
KR 10-2011-0131973 A 12/2011

*Primary Examiner* — Prabodh M Dharia
(74) *Attorney, Agent, or Firm* — Knobbe Martens Olson & Bear LLP

(57) ABSTRACT

A display device which includes a substrate having a pixel unit that receiving first and second voltages is disclosed. In one aspect, the first and second power lines are coupled to the first and second voltages, and are supplied to the pixel unit via first and second power pads. In some aspects, the first and second power pads are alternately disposed while being spaced apart from each other in at least a portion of the peripheral area, and the second power pads are disposed in the space between the respective first power pads.

7 Claims, 3 Drawing Sheets

(56) References Cited

U.S. PATENT DOCUMENTS

2009/0315459 A1* 12/2009 Kwon et al. ..... 313/505
2010/0062553 A1* 3/2010 Sung et al. ..... 438/28
2010/0112887 A1 5/2010 Kim et al.
2011/0063537 A1* 3/2011 Kim ..... G02F 1/13338 349/42
2011/0102402 A1* 5/2011 Han ..... 345/211
2011/0279982 A1* 11/2011 Kim ..... 361/720
2011/0291115 A1 12/2011 Kim et al.
2011/0291119 A1* 12/2011 Ryu et al. ..... 257/88
2012/0134122 A1* 5/2012 Kim ..... 361/749
2012/0327056 A1* 12/2012 Lee ..... G09G 3/006 345/211

* cited by examiner

DISPLAY APPARATUS

CROSS REFERENCE TO RELATED APPLICATIONS

This application claims priority to and the benefit of Korean Patent Application No. 10-2012-0108568, filed on Sep. 28, 2012, in the Korean Intellectual Property Office, the entire content of which is incorporated herein by reference. Any and all applications for which a foreign or domestic priority claim is identified in the Application Data Sheet as filed with the present application are hereby incorporated by reference under 37 CFR 1.57.

BACKGROUND

1. Field

The present disclosure relates to a flat panel display, specifically, to a display driven by varying voltage levels.

2. Description of the Related Technology

Organic light emitting display devices display images using organic light emitting diodes (OLEDs) that emit light through recombination of electrons and holes. Since the OLED display device has a fast response speed and is driven with low power consumption, if it has been identified as a next-generation display.

Generally, the OLED display device includes a pixel unit having a matrix of pixels, driving circuits for supplying driving signals to the pixel unit, and a power supply circuit for supplying pixel power to the pixel unit.

When a scan signal is supplied to each pixel, the pixel is synchronized with a gate signal so as to emit light with luminance corresponding to a data signal.

However, in the OLED display device, the emission luminance of the pixels is influenced by the applied voltage level. That is, the voltage applied to a pixel, or pixel power, becomes a factor in the resulting emission luminance of the pixels, in addition to the data signal.

Therefore, the same voltage should be applied to each pixel so as to display images having uniform image quality.

However, pixel power is a DC voltage determined by the difference between a power supply voltage having a high voltage level and a ground voltage having a low voltage level. While passing through a power line, a voltage drop (IR drop) occurs in the power voltage, and a voltage rise (IR rise) occurs in the ground voltage.

In the case where the voltage drop and the voltage rise overlap with each other, the luminance inequality of the display panel increases, and white spots may be locally produced.

Particularly, as the display panel of the display device becomes large in size, the length of the power line is lengthened, and therefore, the difference in luminance between the pixels may be increased according to distances from power pads for receiving pixel power supplied from the power supply circuit.

SUMMARY

Embodiments described herein provide a display device for reducing luminance inequality.

Various embodiments reduce luminance inequality. One aspect relates to a display device, comprising a substrate having a pixel unit configured to display an image powered by a first voltage and second voltage, wherein the first and second voltages are different; a peripheral area at the outside of the pixel unit; first power lines through which the first voltage is supplied to the pixel unit; second power lines through which the second voltage is supplied to the pixel unit; and first power pads electrically coupled to the first power lines configured to provide the first voltage to the first power lines; and second power pads electrically coupled to the second power lines configured to provide the second voltage to the second power lines; wherein the first and second power pads are alternately disposed in at least a portion of the peripheral area, the first power pads being spaced apart from each other, and the second power pads being disposed in the space between the first power pads.

In some embodiments, the first and second power pads are spaced apart from each other at a constant interval.

In some embodiments, the first and second power pads are arranged along at least two sides of the substrate.

In some embodiments, the first and second power pads are arranged along opposite sides of the substrate such that at least one of the first power pads is aligned opposite another of the first power pads.

In some embodiments, the first and second power pads are arranged on opposite sides of the substrate such that at least one of the first power pads is aligned opposite one of the second power pads.

In some embodiments, the first and second power lines are disposed substantially parallel to each other, the first and second power lines forming a pair.

In some embodiments, the first and second power pads have equivalent dimensions.

In some embodiments, the first voltage is a high voltage relative to the second voltage and the second power is a low voltage relative to the first voltage.

In some embodiments, the pixel unit comprises pixels which each comprise an organic light emitting diode.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
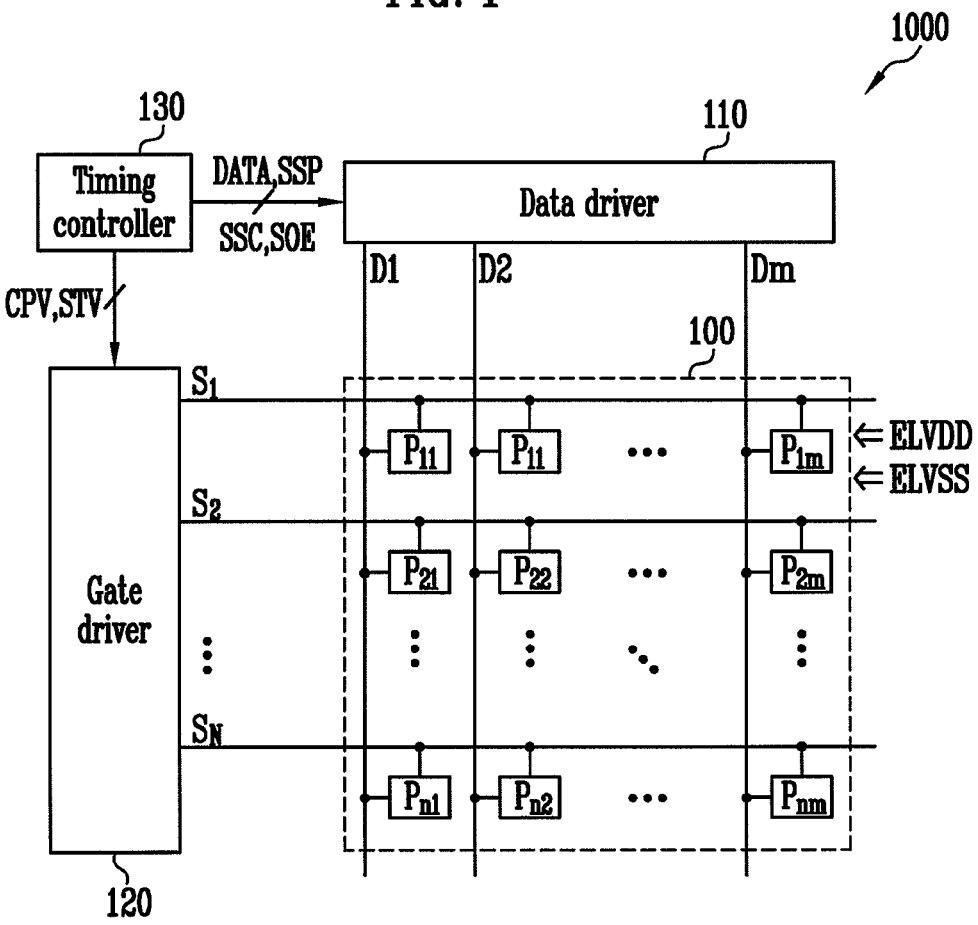
FIG. 1 is a diagram illustrating the structure of a display device according to one embodiment.

Hereinafter, some exemplary embodiments according of a display device will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 is a block diagram illustrating the structure of a display device according to an embodiment of the present invention.

Referring to FIG. 1, the display device 1000 includes a pixel unit 100 having a plurality of pixels P11 to Pnm coupled to gate lines S1 to Sn and data lines D1 to Dm, a data driver 110 that outputs a data voltage corresponding to an input image to each pixel P11 to Pnm through the data lines D1 to Dm, a gate driver 120 that outputs scan signals to each pixel P11 to Pnm through the gate lines S1 to Sn, and a timing controller 130 that generates control signals and outputs the generated control signals to the data driver 110 and the gate driver 120.

The gate driver 120 may perform an operation of outputting an emission control signal to a plurality of emission control lines (not shown) connected to the plurality of pixels, as well as the scan signals.

The pixel unit 100 has the pixels P11 to Pnm positioned at intersection portions of the gate lines S1 to Sn and the data lines D1 to Dm. The pixels P11 to Pnm may be arranged in an n×m matrix as shown in FIG. 1.

Each of the pixels P11 to Pnm includes a light emitting device, and receives a first power ELVDD as a high power voltage and a second power ELVSS as a low power voltage, which are supplied from the outside of the pixel unit 100, which power the light emitting device (organic light emitting diode).

Each pixel P11 to Pnm allows the light emitting device to emit light with luminance corresponding to a data voltage by supplying driving current or voltage to the light emitting device.

Each pixel P11 to Pnm controls the amount of current supplied to the light emitting device, corresponding to the data voltage provided through the data lines D1 to Dm, and the light emitting device emits light with luminance corresponding to the data voltage.

The timing controller 130 receives an input image signal and an input control signal for controlling display of the input image signal from an external graphic controller (not shown). The timing controller 130 generates an input image data DATA, a source start pulse SSP, a source shift clock SSC, a source output enable SOE, etc. from the input image signal and the input control signal, and provides them to the data driver 110.

The timing controller 130 generates a gate driving clock CPV, a start pulse STV, etc., and outputs them to the gate driver 120.

Figure 2:
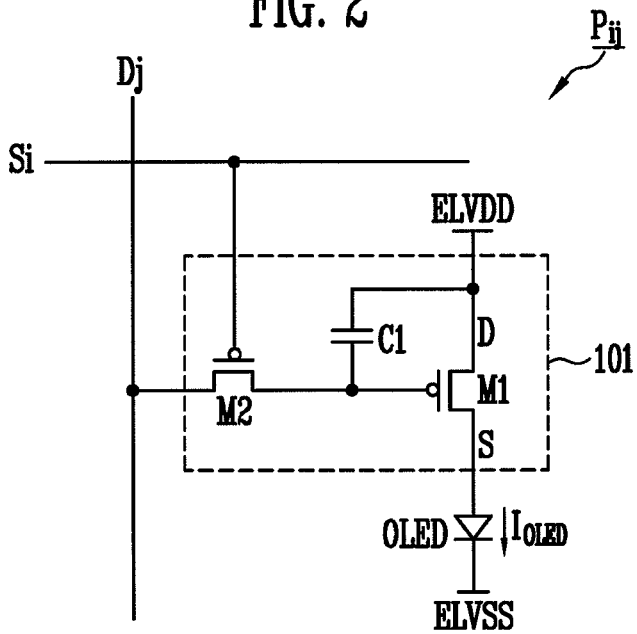
FIG. 2 is a circuit diagram illustrating the structure of an embodiment of a pixel shown in FIG. 1.

FIG. 2 is a circuit diagram illustrating the structure of an embodiment of a pixel shown in FIG. 1.

The organic light emitting display device depicted in FIG. 2 is exemplary, and should not be construed as limiting pixel unit 100 provided in display device 1000 shown in FIG. 1.

Referring to FIG. 2, the pixel Pij according to this embodiment includes an OLED as a light emitting device, and a pixel circuit 101.

The OLED receives driving current $I_{OLED}$ input from the pixel circuit 101 so as to emit light. The luminance of the light emitted from the OLED is changed depending on the amplitude of the driving current $I_{OLED}$.

The pixel circuit 101 includes a capacitor C1, a driving transistor M1 and a switching transistor M2.

The driving transistor M1 includes a first terminal D to which a first power ELVDD is supplied, a second terminal S coupled to an anode of the OLED, and a gate terminal coupled to a second terminal of the switching transistor M2.

The anode of the OLED is coupled to the second terminal S of the driving transistor M1, and a cathode of the OLED is coupled to a second power ELVSS.

The switching transistor M2 includes a first terminal coupled to a data line Dj, a second terminal coupled to the gate terminal of the driving transistor M1, and a gate terminal coupled to a scan line S1.

The capacitor C1 is coupled between the gate terminal and the first terminal D of the driving transistor M1.

If a scan signal having a gate-on level is applied to the switching transistor M2 through the scan line Si, a data voltage supplied from data line Dj is applied to the gate terminal of the driving transistor M1 and a first terminal of the capacitor C1 through the switching transistor M2. While a data voltage is applied through the data line Dj, a voltage level corresponding to the data voltage is charged in the capacitor C1.

The driving transistor M1 generates driving current $I_{OLED}$ according to the voltage level of the data voltage and outputs the generated driving current $I_{OLED}$ to the OLED.

The OLED receives the driving current $I_{OLED}$ input from the pixel circuit 101, so as to emit light with luminance corresponding to the data voltage.

Figure 3:
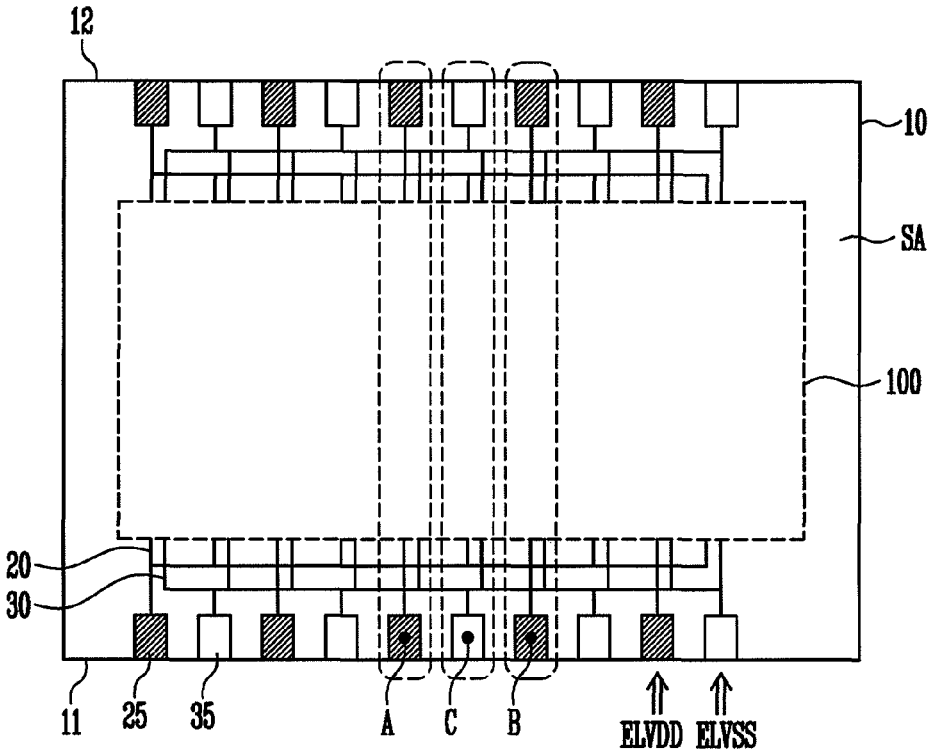
FIG. 3 is a plan view illustrating the structure of first and second power pads which provide power to a pixel unit of FIG. 1.
Figure 4:
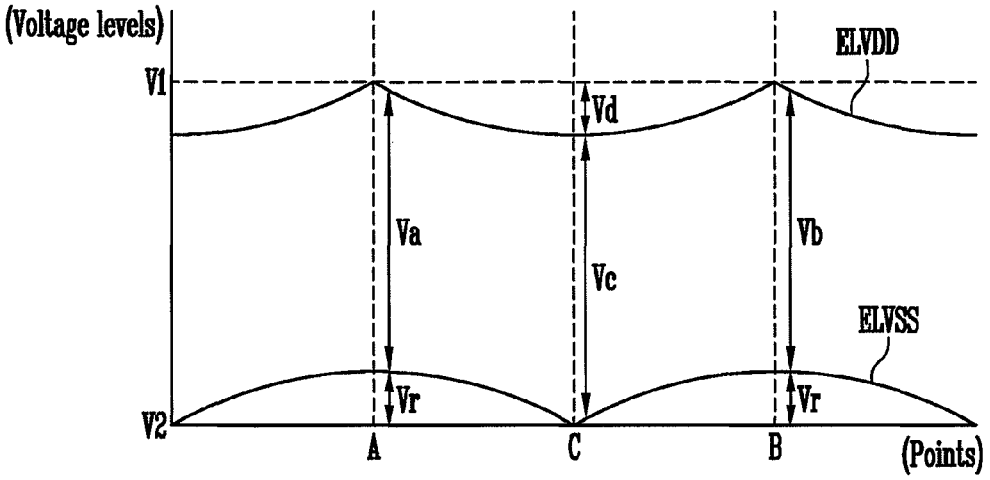
FIG. 4 is a graph illustrating voltage levels of first and second powers at points A, B and C shown in FIG. 3.

FIG. 3 is a plan view illustrating the structure of first and second power pads which provide power to the pixel unit of FIG. 1. FIG. 4 is a graph illustrating voltage levels of the first and second powers at points A, B and C shown in FIG. 3.

Referring to FIG. 3, first and second power lines 20 and 30 and first and second power pads 25 and 35 are formed on a substrate 10. Although not shown in this figure, the data and gate drivers 110 and 120 described above may also be mounted on the substrate 10.

The substrate 10 is implemented as a transparent insulating substrate. The substrate 10 has the pixel unit 100 for displaying an image and a peripheral area (SA) at the outside of the pixel unit 100.

The pixel unit 100 may be disposed in a central portion of the substrate 10. The first and second powers ELVDD and ELVSS that are static voltage DC powers having voltage levels different from one another are supplied to the pixel unit 100.

In this embodiment, the first power ELVDD is a high power voltage having a high voltage level, and the second power ELVSS is a low power voltage having a low voltage level. For example, the first power ELVDD may have a positive voltage level of 15V, and the second power ELVSS may have a negative voltage level of −5V or a ground voltage level of 0V.

The first power lines 20 and the second power lines 30 supply the respective first and second powers ELVDD and ELVSS to the pixel unit 100. The first and second power lines 20 and 30 are disposed in parallel with each other while forming a pair.

Although not shown in detail in this figure, the first and second power lines 20 and 30 are extended into the pixel unit 100 so as to form a network, and may supply the first power ELVDD and the second power ELVSS to each pixel P11 to Pnm. Alternatively, the first and second power lines 20 and 30 may be respectively coupled to conductive layers formed to overlap with the pixel unit 100. In this case, the conductive layers may be electrically coupled to the respective pixels P11 to Pnm through contact holes so as to supply power The first and second power lines 20 and 30 may be formed of a transparent conductive material or low-resistive metal such as molybdenum (Mo), silver (Ag), titanium (Ti), aluminum (Al) or copper (Cu), or may be formed into a stacked structure of the metals.

The first power pads 25 are electrically coupled to the first power lines 20 so as to provide the first power ELVDD applied from the outside, and the second power pads 35 are electrically coupled to the second power lines 30 so as to provide the second power ELVSS applied from the outside.

Here, the first power ELVDD may include sub-powers having different voltage levels, which are respectively supplied to red, green and blue pixels. The second power pads 25 may also include a plurality of sub-power pads (not shown) corresponding to the respective sub-powers.

The first and second power pads 25 and 35 are alternately disposed while being spaced apart from each other in at least a portion of the peripheral area SA.

As one embodiment, the first and second power pads 25 and 35 may be arranged along one side 11 of the substrate 10 and the other side 12 opposite to the one side 11 of the substrate 10. Here, the first and second power pads 25 and 35 arranged along the one side 11 and the first and second power pads 25 and 35 arranged along the other side 12 may be arranged symmetrical to each other.

The first and second power pads 25 and 35 may have the same area. The first and second power pads 25 and 35 may be formed of the same material in the same layer as the first and second power lines 20 and 30.

As another embodiment, the first and second power pads 25 and 35 may be formed in a region protruded outward from the one side 11 of the substrate 10.

A pad portion of a driving circuit board (not shown) that supplies the first power ELVDD and the second power ELVSS is electrically coupled to the first and second power pads 25 and 35. For the purpose of the coupling, an anisotropic conductive film may be interposed between the pad portion of the driving circuit board and the first and second power pads 25 and 35.

As described above, the power for driving the pixel unit 100 is a DC power determined by the difference between the first power ELVDD and the second power ELVSS. While the power for driving the pixel unit 100 passes through the first and second power lines 20 and 30, a voltage drop (IR drop) occurs in the first power ELVDD having a high voltage level, and a voltage rise (IR rise) occurs in the second power ELVSS having a low voltage level.

However, since a power voltage pad and a ground voltage pad are disposed adjacent to each other while forming a pair, like connection lines, in the related art display device, the voltage drop and voltage rise overlaps with each other in a region between the pads, and therefore, the luminance inequality of the display panel increases. Accordingly, white spots may be locally produced.

According to this embodiment, the second power pads 35 are disposed in central regions between the respective first power pads 25, so that it is possible to prevent the phenomenon that the voltage drop and voltage rise overlap with each other and to minimize the luminance inequality of the display panel, thereby improving image quality.

Specifically, the first and second power pads 25 and 35 are alternately disposed along the one side 11 of the substrate 10, and are preferably spaced apart from each other at a constant interval so as not to be adjacent to each other or to be biased to any one side.

The distribution of voltage levels of the first and second powers ELVDD and ELVSS at the points A, B and C of FIG. 3 will be described with reference to FIG. 4.

The voltage drop of the first power ELVDD does not occur at the points A and B at which the first power pads 25 are positioned, but the voltage rise of the second power ELVSS occurs due to a spacing distance from the second power pads 35. Therefore, A voltage Va, obtained by subtracting a voltage increment Vr from the first voltage level V1 of the first power ELVDD, becomes a significant voltage level at the point A.

Here, the spacing distances of the points A and B from the point C at which the second power ELVSS is input are identical to each other, and hence the voltage increments Vr of the points A and B are identical to each other. As a result, the A voltage Va and the B voltage Vb are identical to each other.

The voltage rise of the second power ELVSS does not occur at the point C, where the second power pad 35 is positioned, but the voltage drop of the first power ELVDD occurs due to a spacing distance from the first power pads 25. Therefore, C voltage Vc, obtained by subtracting a voltage decrement Vd from the first voltage level V1 of the first power ELVDD, becomes a significant voltage level at the point C.

Here, the point C is the middle between the points A and B, and hence the line resistances of the power lines at the three points are identical to one another when being viewed from each point. Since the line resistances at the three points are identical to each other, the voltage decrement Vd at the point C is identical to the voltage increment Vr at the points A and B. As a result, the C voltage Vc, the A voltage Va and the B voltage Vb are identical to one another.

The points A, B and C are set based on any one point on the first and second power pads 25 and 35, but the first and second power lines 20 and 30 extended from the first and second power pads 25 and 35 are extended in equal proportion at an equal ratio. Therefore, the voltage levels at the points A, B and C show a similar voltage-level distribution in the inside of the pixel unit 100, as well as the first and second power lines 20 and 30.

Although it has been described in this embodiment that the second power pads 35 are disposed in the central regions between the respective first power pads 25, this is relative, and has the substantially same structure and effect as the first power pads 25 are disposed in the central regions between the respective power pads 35.

As described above, the first and second power pads 25 and 35 are spaced apart from each other at a uniform interval so as not to be adjacent to each other or to be biased to any one side, so that the difference in voltage between the first and second power pads 25 and 35 can be equally distributed. Further, the difference between voltages supplied to the pixel unit 100 is equalized, so that it is possible to improve luminance inequality.

Figure 5:
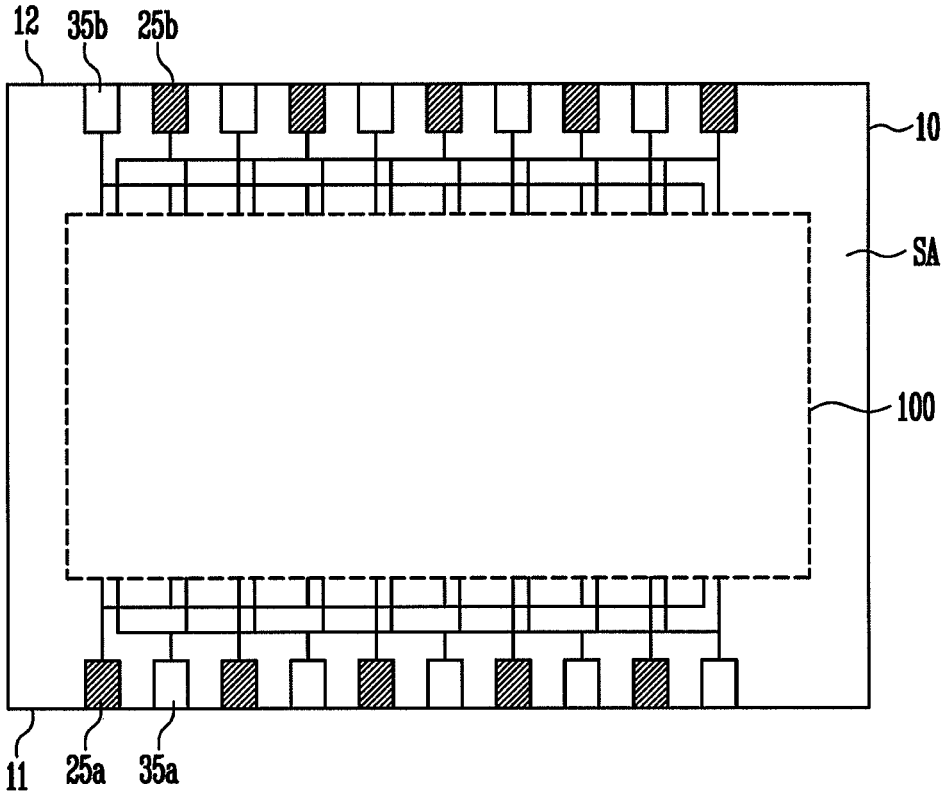
FIG. 5 is a plan view illustrating the structure of first and second power pads according to another embodiment.

FIG. 5 is a plan view illustrating the structure of first and second power pads according to another embodiment of the present invention. In this embodiment, components having the same reference numerals as those in the aforementioned embodiment may refer to the aforementioned descriptions, and therefore, their descriptions will be omitted to avoid redundancy.

Referring to FIG. 5, in the power pads according to this embodiment, first and second power pads 25*a* and 35*a* arranged along a first side 11 of the substrate 10 and first and second power pads 25*b* and 35*b* arranged along a second side 12 of the substrate 10 may be arranged to be across from each other.

The voltage level at a specific point on the substrate 10 is distorted in proportion to line resistance of the first and second power lines 20 and 30, and the line resistance is determined according to spacing distances from the first and second power pads 25*b* and 35*b*, to which the respective first and second powers ELVDD and ELVSS are supplied. Thus, the first and second power pads 25*b* and 35*b* are distributed as equally as possible, so that it is possible to maximize uniformity of the line resistance.

In this embodiment, the first and second power pads 25*a* and 35*a* are disposed to be across from each other based on the width of the substrate 10 as well as the length direction of the substrate 10, so that it is possible to simultaneously improve the equality of the voltage level distribution in the length direction of the substrate 10 and the equality of the voltage level distribution in the width direction of the substrate 10.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A display device, comprising:

a substrate having a pixel unit configured to display an image powered by a first voltage and second voltage, wherein the first and second voltages are different;

a peripheral area at the outside of the pixel unit;

first power lines through which the first voltage is supplied to the pixel unit;

second power lines through which the second voltage is supplied to the pixel unit; and first power pads electrically coupled to the first power lines configured to provide the first voltage to the first power lines; and second power pads electrically coupled to the second power lines configured to provide the second voltage to the second power lines;

wherein the first and second power pads are alternately disposed in at least a portion of the peripheral area along two opposite sides of the pixel unit, the first power pads being spaced apart from each other, and the second power pads being disposed in the space between the first power pads, and wherein the first power pads along one of the opposite sides are formed opposite the second power pads along the other of the opposite sides.

2. The display device according to claim 1, wherein the first and second power pads are spaced apart from each other at a constant interval.

3. The display device according to claim 1, wherein the first and second power lines are disposed substantially parallel to each other, the first and second power lines forming a pair.

4. The display device according to claim 1, wherein the first and second power pads have equivalent dimensions.

5. The display device according to claim 1, wherein the first voltage is a high voltage relative to the second voltage and the second power is a low voltage relative to the first voltage.

6. The display device according to claim 1, wherein the pixel unit comprises pixels which each comprise an organic light emitting diode.

7. A display device, comprising:

a substrate having a pixel unit configured to display an image powered by a first voltage and second voltage, wherein the first and second voltages are different;

a peripheral area at the outside of the pixel unit;

first power lines through which the first voltage is supplied to the pixel unit;

second power lines through which the second voltage is supplied to the pixel unit; and first power pads electrically coupled to the first power lines configured to provide the first voltage to the first power lines; and second power pads electrically coupled to the second power lines configured to provide the second voltage to the second power lines;

wherein the first and second power pads are alternately disposed in at least a portion of the peripheral area along two opposite sides of the pixel unit, the first power pads being spaced apart from each other, and the second power pads being disposed in the space between the first power pads, and wherein the first and second power pads are arranged along opposite sides of the substrate such that at least one of the first power pads is aligned opposite another of the first power pads.

* * * * *